United States Patent [19]

Mikoshiba et al.

[11] Patent Number: 4,839,637

[45] Date of Patent: Jun. 13, 1989

[54] METHOD OF DRIVING GAS-DISCHARGE PANEL

[75] Inventors: Shigeo Mikoshiba, Suginami; Shinichi Shinada, Kokubunji; Takahiro Matsumoto, Hachioji, all of Japan

[73] Assignee: Hitachi, Ltd., Tokyo, Japan

[21] Appl. No.: 13,123

[22] Filed: Feb. 10, 1987

[30] Foreign Application Priority Data

Feb. 10, 1986 [JP] Japan ..... 61-25854
Feb. 17, 1986 [JP] Japan ..... 61-30841

[51] Int. Cl.[4] ..... G09G 3/22; G09G 3/28

[52] U.S. Cl. ..... 340/775; 315/84.51; 315/84.61; 315/169.4

[58] Field of Search ..... 340/752, 766, 771, 772, 340/773, 775, 776, 779, 789, 791, 798, 799, 800, 805; 315/84.51, 84.61, 167, 169.1, 169.4

[56] References Cited

U.S. PATENT DOCUMENTS

| | | | |
|---|---|---|---|
| 3,719,940 | 3/1973 | Lay et al. | 340/805 |
| 3,803,586 | 4/1974 | Johanns et al. | 340/805 |
| 4,132,924 | 1/1979 | Yamaguchi et al. | 340/805 |
| 4,160,932 | 7/1979 | Mikoshiba et al. | 340/775 |
| 4,185,229 | 1/1980 | Yoshikawa et al. | 315/169.4 |
| 4,566,006 | 1/1986 | Okamoto et al. | 340/805 |
| 4,692,666 | 9/1987 | Okamoto et al. | 340/776 |
| 4,761,773 | 9/1973 | Johnson et al. | 340/776 |

*Primary Examiner*—Gerald L. Brigance
*Assistant Examiner*—Richard Hjerpe
*Attorney, Agent, or Firm*—Antonelli, Terry & Wands

[57] ABSTRACT

A method of driving a gas-discharge display panel in which a plurality of discharge cells constructed of display anodes and cathodes are arrayed in the form of a matrix, comprising affording a predetermined phase difference between a display pulse which is impressed on the discharge cell and a display pulse which is impressed on the discharge cell adjoining the former cell.

2 Claims, 9 Drawing Sheets

METHOD OF DRIVING GAS-DISCHARGE PANEL

BACKGROUND OF THE INVENTION

The present invention relates to a method of driving a flat discharge panel for displaying a picture, constructed of discharge display elements which exploit visible or ultraviolet radiation generated by a gas discharge.

A drive system for a gas-discharge panel with a memory function is described in, for example, U.S. Pat. No. 4,099,096. FIG. 1 illustrates an example of another panel structure to which the present invention is applied. In the figure, numeral 1 designates an insulating substrate, numeral 2 a cathode lead, numeral 3 a cathode resistor, numeral 4 a cathode, numeral 5 a subsidiary anode, numeral 6 a subsidiary discharge space, numeral 7 a display discharge space, numeral 8 a phosphor, numeral 9 a display anode, and numeral 10 a light-transmissive faceplate.

The gas-discharge cells as shown in FIG. 1 are arrayed in the form of a matrix as illustrated in FIG. 2. Referring to FIG. 2, numeral 11 indicates a matrix panel, numeral 12 a display anode lead, numeral 15 a subsidiary anode lead, numeral 18 a display anode driver circuit, numeral 19 a cathode driver circuit, and numeral 20 a subsidiary anode driver circuit.

The outline of a method of driving the matrix panel shown in FIG. 2 will be described with reference to FIGS. 3 and 4. In FIG. 3, symbols $V_{K1}$, $V_{K2}$ and $V_{K3}$ denote the waveforms of voltages which are applied to the first, second and third cathode leads, respectively. Besides, symbols $V_{A1}$, $V_{A2}$ and $V_{A3}$ denote the waveforms of voltages which are applied to the first, second and third display anode leads, respectively. Symbols $V_{S1}$, $V_{S2}$ and $V_{S3}$ denote the waveforms of voltages which are applied to the first, second and third subsidiary anode leads, respectively.

When the voltages of the waveforms shown in FIG. 3 are applied to the panel, the display discharges of hatched discharge cells 13 within the 3×3-cell matrix panel shown in FIG. 4 turn "on." More specifically, when the individual cells are numbered as indicated in FIG. 4, the cells (1, 1), (1, 2) and (1, 3) are lit up at a time $t_7$, the cells (1, 1), (1, 2), (1, 3) and (2, 2) at a time $t_8$, and the cells (1, 1), (1, 2), (1, 3), (2, 2) and (3, 2) at times $t_9$, $t_{10}$ and $t_{11}$.

The system of the above construction, however, is somewhat unstable in the display operation. That is, it is sometimes the case that the crosstalk between the adjacent discharge cells, for example, the cells (1, 1) and (1, 2) renders the lighting of one discharge cell (1, 2) unstable, so flickering appears on a display screen.

SUMMARY OF THE INVENTION

An object of the present invention is to prevent the unstable display operation stated above, and to provide a stable panel operation.

In order to investigate the cause of the unstable panel operation, the inventors conducted a test for the lighting characteristics of individual discharge cells. FIG. 5(*a*) shows the lighting characteristics of the discharge cells adjoining horizontally (for example, the discharge cells (1, 1) and (1, 2)). The characteristics of FIG. 5(*a*) were obtained by measuring the lighting voltages of both the cells in such a way that voltages illustrated in FIG. 5(*b*) were applied to the respective cells while the time interval $\tau$ between the applications of the voltages was varied. When the times at which the voltages are applied to both the cells are sufficiently off, both the cells present the same lighting voltage characteristics similarly to a case where they are driven independently of each other. However, when the time interval $\tau$ is less than 0.7 μs, the lighting voltage of the cell (1, 2) rises, so that the operating margin of the panel narrows to render the display operation unstable.

In the present invention, therefore, the times at which the display lighting voltage pulses of discharge cells adjoining each other are impressed are staggered in order to realize the stable display operation of a panel. When the phase difference of the adjacent display pulses is not less than 0.7 μs, the instability is perfectly eliminated. As seen from FIG. 5(*a*), however, the probability of the instability becomes considerably low even when the phase difference is about 0.5 μs.

DETAILED DESCRIPTION:

Now, embodiments of the present invention will be described with reference to the drawings.

Figure 6:
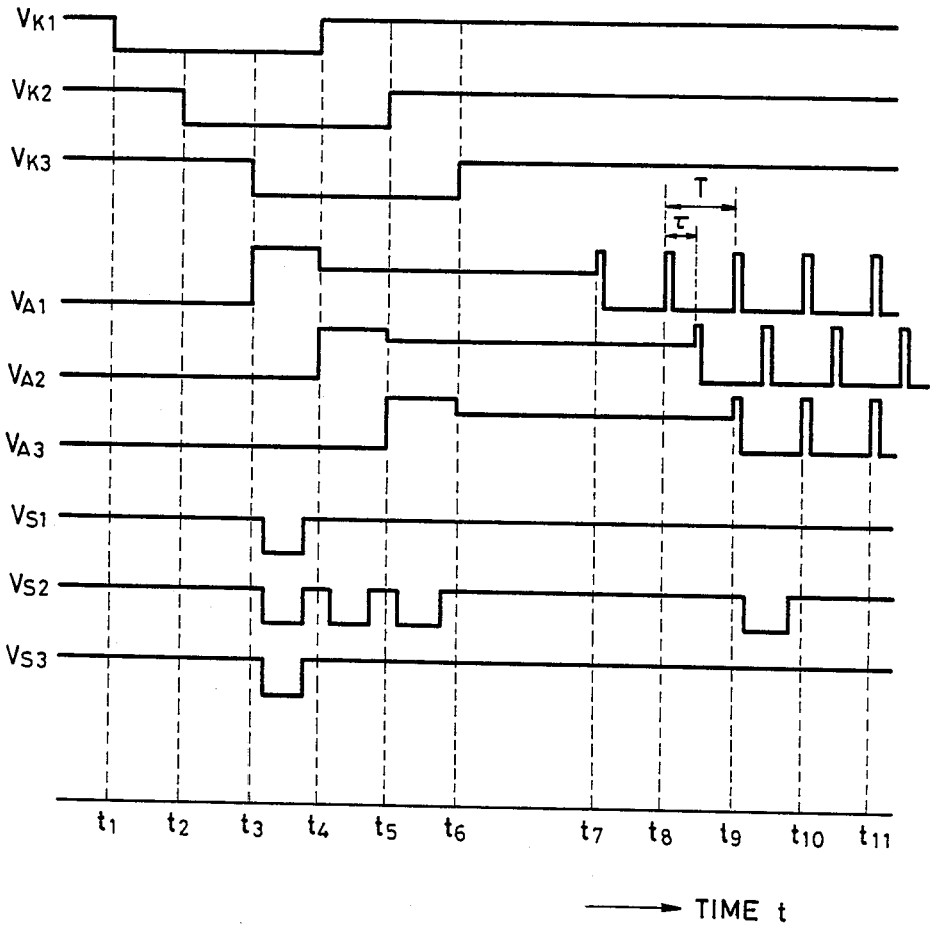
FIG. 6 is a diagram showing the waveforms of voltages which are applied to various electrodes in the present invention.

FIG. 6 shows the waveforms of voltages which are applied to respective electrodes in the present invention. In FIG. 6, the applied voltages $V_{A1}$, $V_{A2}$ and $V_{A3}$ to the display anodes are applied at periods T. Among them, the voltage $V_{A2}$ is applied with a delay of a certain time interval $\tau$ as compared with the voltage $V_{A1}$. In this example, each period T=8 μs, and the time interval $\tau$=0.7 μs.

Figure 7:
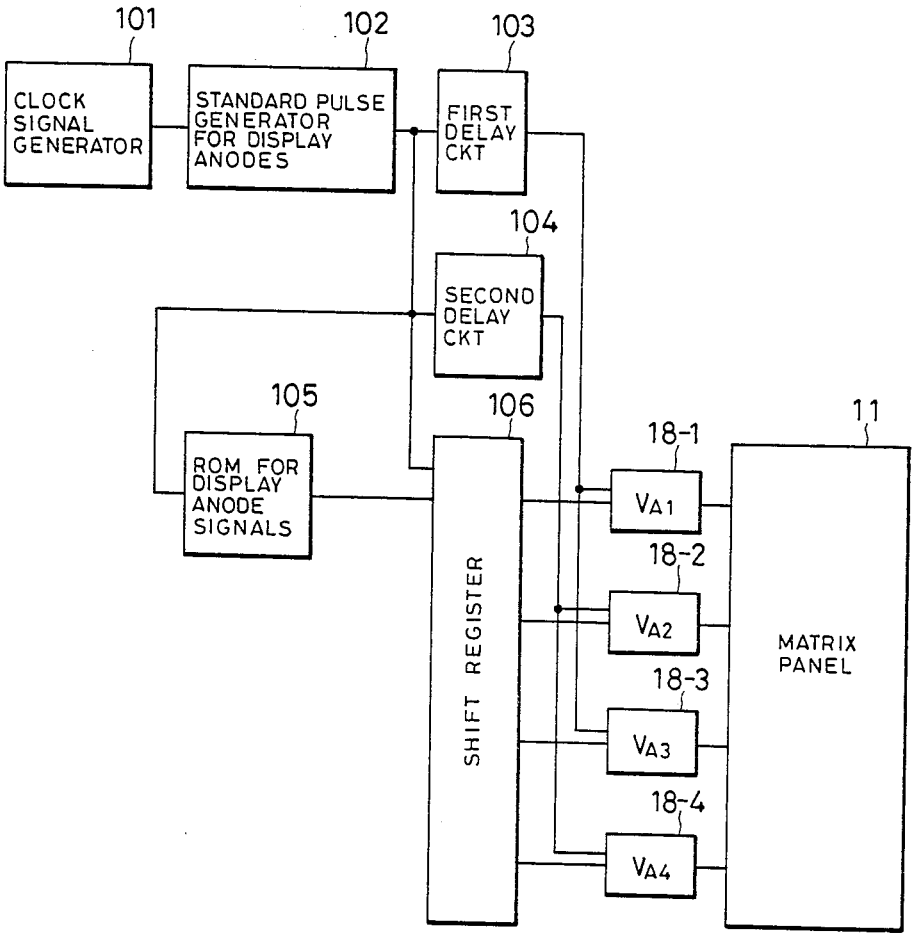
FIG. 7 is a block diagram showing an embodiment of the present invention.

FIG. 7 shows one embodiment of the present invention, and is a block diagram of a driver circuit for generating the applied voltages $V_{A1}$, $V_{A2}$, $V_{A3}$ etc. to the display anodes as shown in FIG. 6. The illustrated embodiment comprises a clock signal generator 101, a generator 102 for the reference pulses of the display anodes, a first delay circuit 103, a second delay circuit 104, a ROM 105 for generating display anode signals, a shift register 106, display anode-driving circuits $V_{A1}$--$V_{A4}$ respectively denoted by symbols 18-1 -18-4, and a matrix panel 11.

Using clock pulses delivered from the clock signal generator 101, the reference pulse generator 102 for the display anodes generates concatenate pulses. The period of the concatenate pulses is equal to the time interval T between times $t_8$ and $t_9$ in FIG. 6, and it has a value of, e. g., about 8 μs. The reference pulses of the display anodes enter the first delay circuit 103 and the second delay circuit 104, and are respectively delayed. The difference $\tau$ of the magnitudes of the delays is, e. g., about 0.7 μs.

Figure 4:
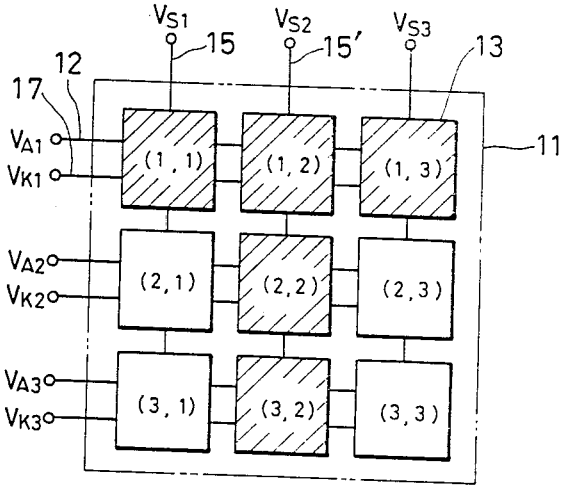
FIG. 4 is a diagram showing a display pattern based on the voltage waveforms in FIG. 3.
Figure 5A:
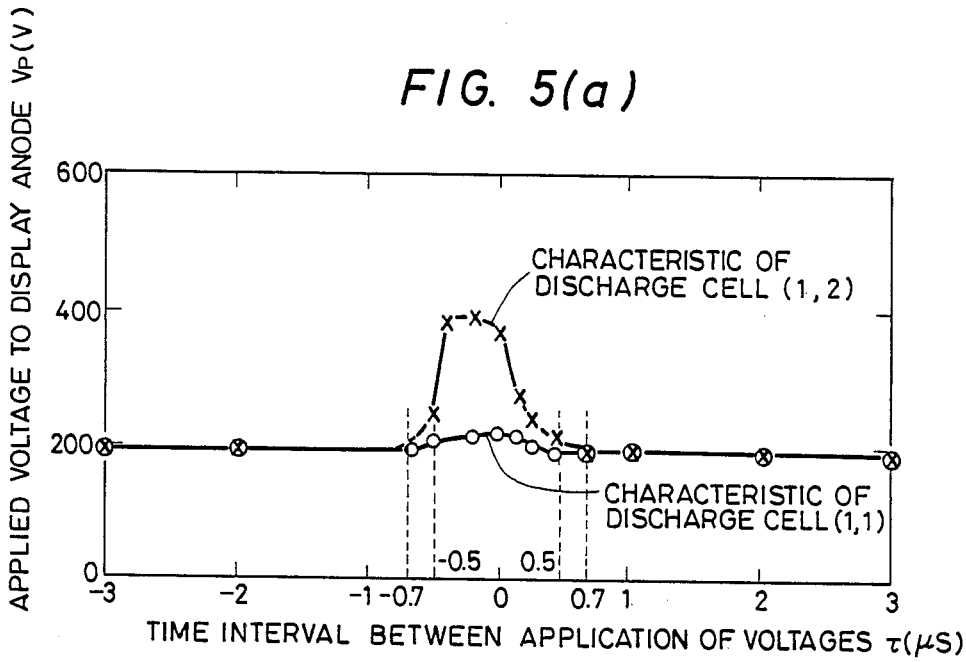
FIGS. 5(*a*) and 5(*b*) and FIG. 8 are diagrams for explaining unstable operation phenomena which arise when the driving system of FIG. 3 is used.
Figure 5B:
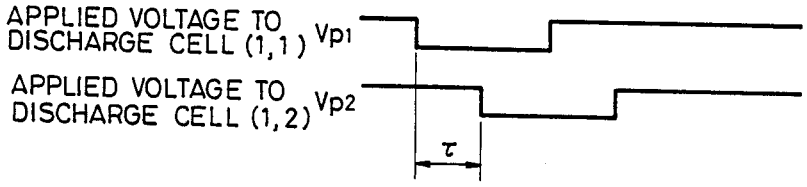

Meanwhile, an interval during which the $V_{A1}$ pulses are to be generated is written as data in the display anode signal-generating ROM 105 beforehand. Thus, the output pulses of the first delay circuit 103 are received in the display anode-driving circuit 18-1 for only the aforementioned interval. This circuit 18-1 further amplifies the pulses to a high voltage, and applies them to the matrix panel 11. The shift register 106 transfers the data written in the display anode signal-generating ROM 105, in succession using the reference pulses of the display anodes as clocks. The data delayed for one clock by the shift register 106 is combined with the output pulses of the second delay circuit 104 in the display anode-driving circuit 18-2, whereby the pulses $V_{A2}$ are impressed on the matrix panel 11. Thenceforth, the pulses $V_{A3}$ and $V_{A4}$ are similarly impressed. In this way, by way of example, the cells (1, 2) and (3, 2) in FIG. 4 emit light at the time $t_9$ in FIG. 6, but the light emission timing of the cell (2, 2) differs from that of the cells (1, 2) and (3, 2), so that the change of the lighting voltage illustrated in FIG. 5(*a*) does not occur in regard to the cells adjacent in the vertical direction.

In this manner, in the example of FIG. 6, the instability of display attributed to the crosstalk between the vertically adjacent discharge cells is not involved.

Figure 8:
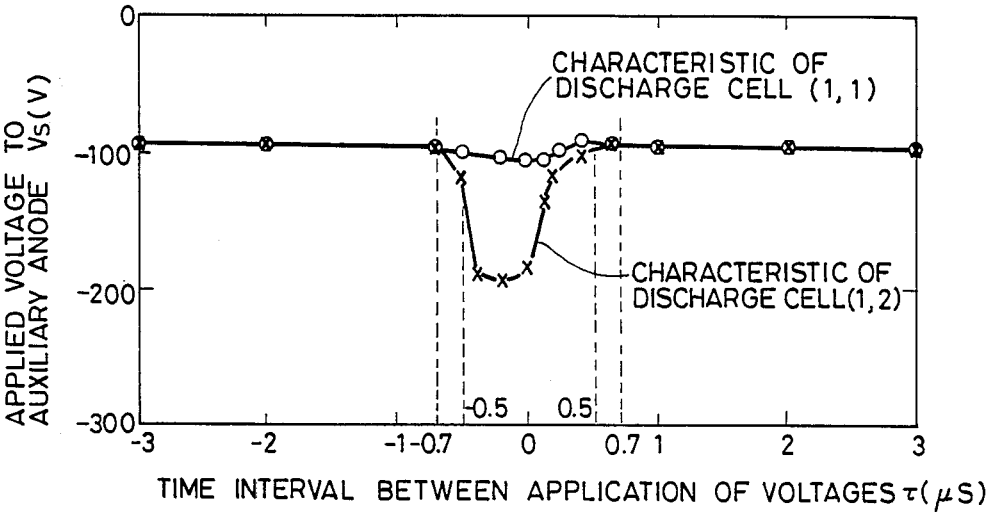

However, the instability of display attributed to the crosstalk between laterally adjacent discharge cells remains as a problem. More specifically, referring to FIG. 3, the applied voltages $V_{S1}$, $V_{S2}$ and $V_{S3}$ to the subsidiary anodes are applied to the cells (1, 1), (1, 2) and (1, 3) at the same interval between times $t_3$ and $t_4$. Also on this occasion, the change of the lighting voltage between the adjacent cells arises, and a display picture becomes unstable. FIG. 8 illustrates the change of the lighting voltage ascribable to the crosstalk between the adjacent cells. The cathode lead 2 which is common to the adjacent discharge cells (1, 1) and (1, 2) in FIG. 4 is grounded. Further, D. C. voltages of 400 V are applied to the subsidiary anode leads 15 and 15' so as to fire the subsidiary discharges of the discharge cells (1, 1) and (1, 2). Subsequently, a D. C. bias voltage of 400 V is applied to the common display anode lead 12 of both the discharge cells, and minus pulse voltages are further applied to the subsidiary anode leads 15 and 15' independently of each other, thereby to measure a voltage $V_S$ necessary for shifting the discharge from one subsidiary discharge space to another.

When the switching voltages $V_S$ of the discharge cells (1, 1) and (1, 2) were separately measured, both were −95 V. Next, the values of the switching voltages $V_S$ in the case where they were applied to both the discharge cells with the time intervals $\tau$ are shown in FIG. 8. It is seen from the figure that, when the time interval between the applications of the switching voltages is greater than 0.7 μs, the voltages of both the discharge cells are −95 V, which agrees with the value obtained in the case of switching the cells independently of each other. However, when the time interval is less than 0.7 μs, the voltage required for switching the discharge cell (1, 2) changes and becomes close to −200 V. In other words, since the operating conditions of the discharge cells (1, 1) and (1, 2) are different, the operating margin for normally operating the matrix panel narrows to results in an unstable operation. In the light of the characteristics in the figure, however, it can be said that the probability of the unstable operation is very low if the time interval is about 0.5 μs.

When a similar experiment was conducted for the discharge cells (1, 1) and (1, 3) in FIG. 4, the phenomenon in which the value of $V_S$ changed depending upon $\tau$ as illustrated in FIG. 8 was not observed. It was accordingly found that the mutual interference between the first and third discharge cells with the second cell intervening therebetween is not involved.

Figure 9:
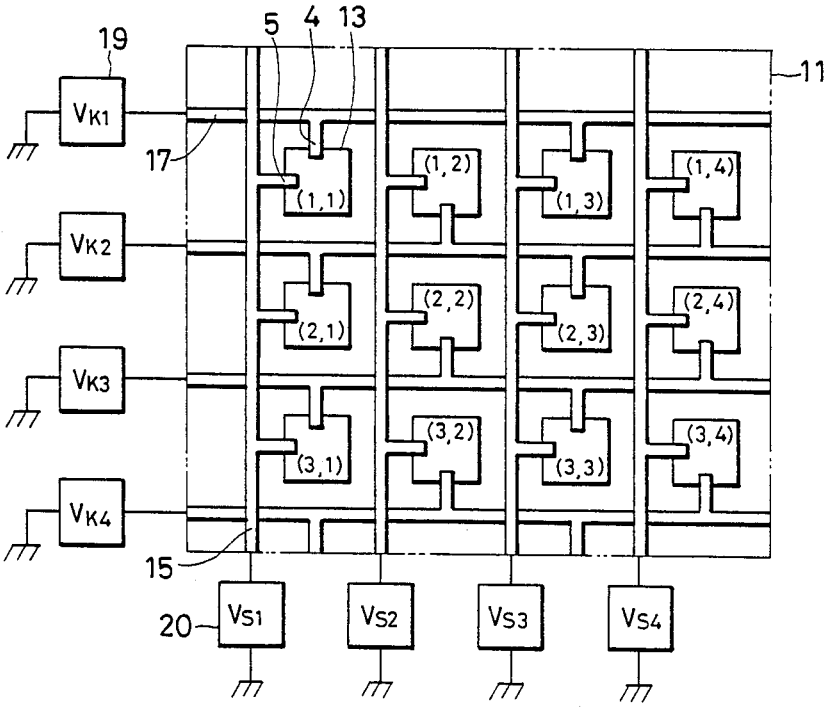
FIGS. 9 thru 14 are connection diagrams each showing discharge cells in a panel in another embodiment of the present invention.

Therefore, the instability of display attributed to the crosstalk between the laterally adjacent discharge cells may be coped with a panel of a structure as shown in FIG. 9 by way of example. Referring to the figure, every second discharge cell as reckoned in the lateral direction is connected to an identical cathode lead 17. Discharge cells adjoining each other are connected to different cathode leads 17. The display anodes of the discharge cells are connected to display anode leads by means similar to that of the cathodes.

When the voltages shown in FIG. 6 are applied to the electrodes of the panel depicted in FIG. 9, the discharge cells (1, 1) and (1, 3), for example, are simultaneously switched, but those (1, 1) and (1, 2) or those (1, 2) and (2, 2) are switched at different times. Thus, the adjacent discharge cells are not simultaneously switched. Accordingly, the increase of the magnitude of the switching voltage $V_S$ as shown in FIG. 8 does not arise, and a stable operation is attained.

Figure 1:
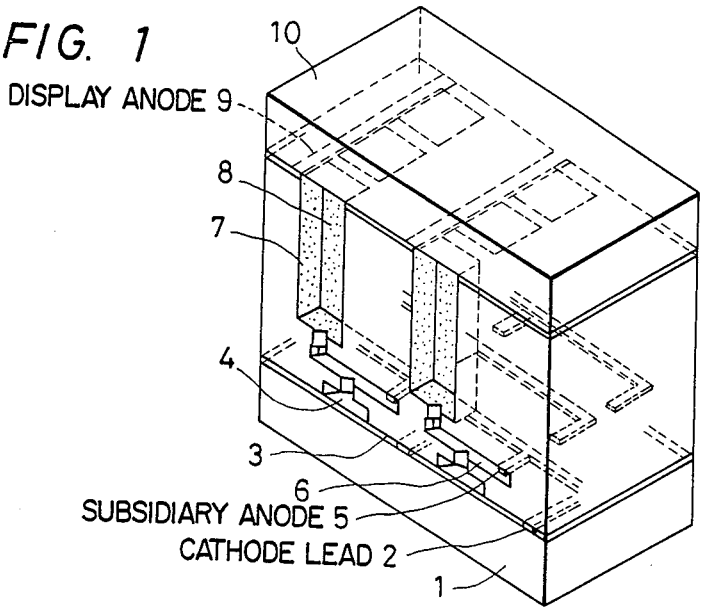
FIG. 1 is a view showing the structure of a gas-discharge panel to which the driving method of the present invention is applied.
Figure 2:
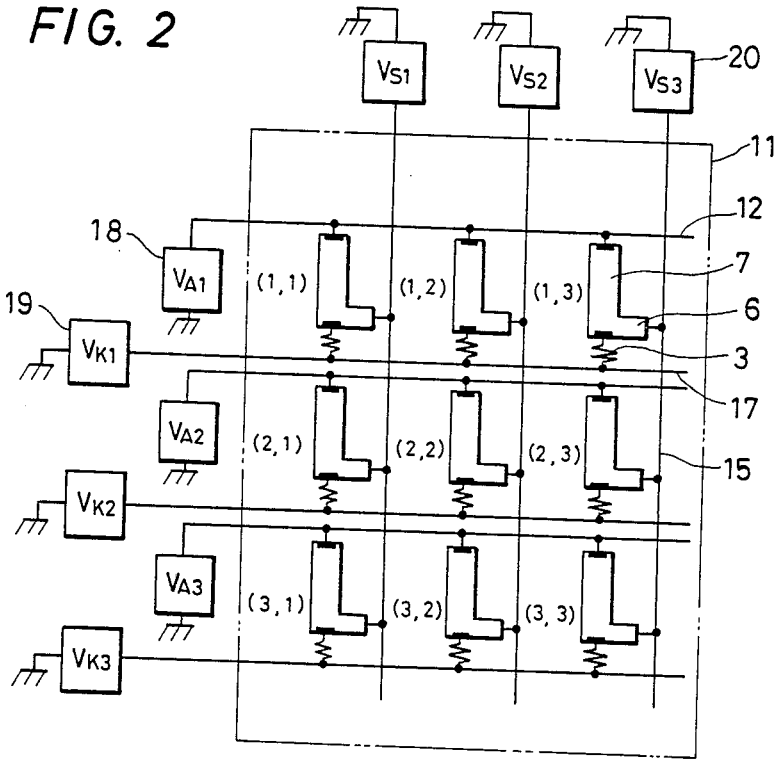
FIG. 2 is a connection diagram of discharge cells in the panel.
Figure 3:
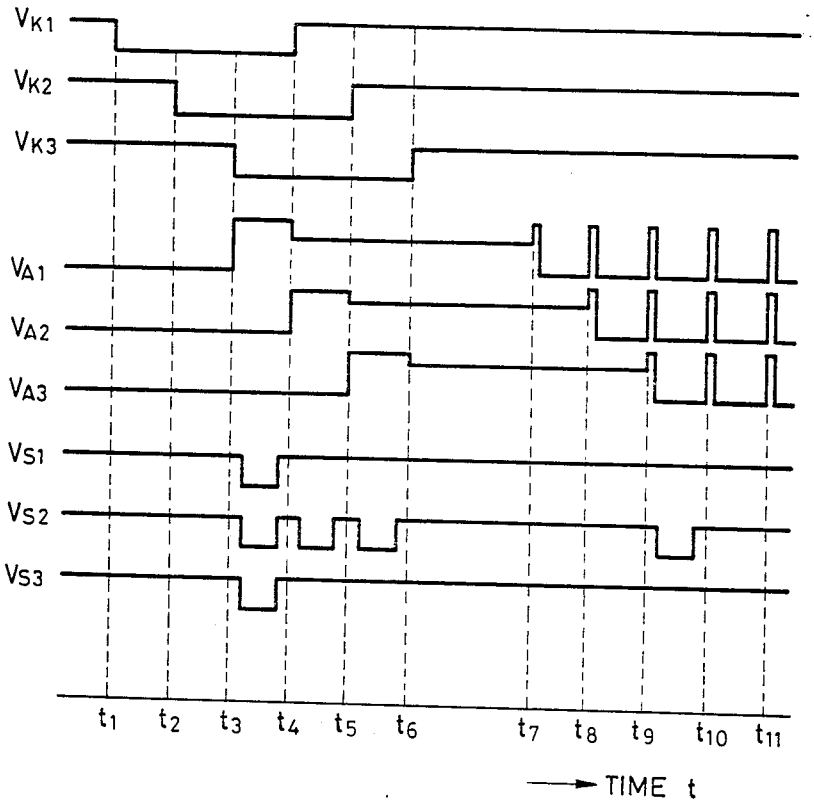
FIG. 3 is a diagram showing the waveforms of panel driving voltages in FIG. 2.

The crosstalk between the laterally adjacent discharge cells is also caused by the voltages $V_{A1}$, $V_{A2}$ and $V_{A3}$ which are applied to the display anode leads at times $t_7$–$t_{11}$ in FIG. 3. By way of example, at the time $t_7$, the pulse $V_{A1}$ is simultaneously impressed on the discharge cells (1, 1), (1, 2) and (1, 3). Accordingly, the crosstalk arises between the respectively adjacent discharge cells, and the discharge lighting voltages fluctuate. As a result, the discharges become unstable, and flickering appears in a display picture.

Figure 10:
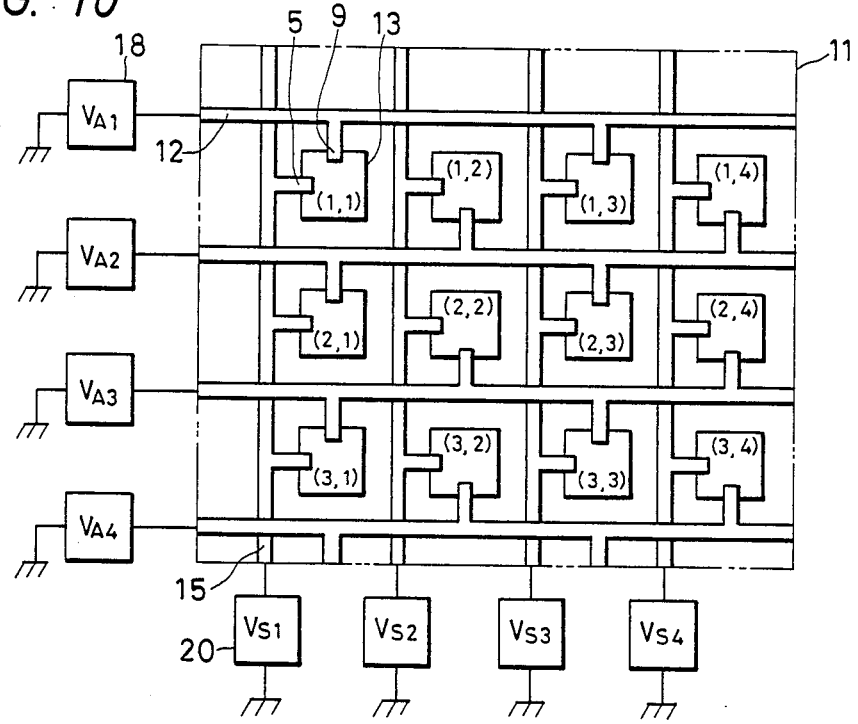

The crosstalk between the discharge cells can be avoided by a display anode connection illustrated in FIG. 10. The figure also shows the connection of subsidiary anodes. The illustrated connection is similar to the cathode connection in FIG. 9. As shown in FIG. 6, the phases of the display pulses of a voltage to be applied as a display anode voltage $V_{A1}$ at times $t_9$, $t_{10}$ and $t_{11}$ are similar to those of the display pulses of a display anode voltage $V_{A3}$. Likewise, the phases of display pulses to be applied to the odd-numbered display anode leads are all equal (if pulses exist) though not shown. On the other hand, the phases of display pulses to be applied to the even-numbered display anode leads are all equal and are staggered for a time interval $\tau$ from those of the odd-numbered display pulses.

By way of example, a discharge cell (2, 2) in FIG. 10 will be referred to. The voltage $V_{A3}$ is applied to the display anode of this cell. Meanwhile, the voltage $V_{A2}$ is applied to an upper cell (1, 2), a left cell (2, 1) and a right cell (2, 3), so that the phases of the display pulses shift from each other. Further, the voltage $V_{A4}$ is applied to a lower cell (3, 2), and the display pulse of this cell similarly shifts in phase from that of the cell (2, 2). Accordingly, all the cells adjoining the cell (2, 2) vertically and laterally are supplied with the display pulse voltages in the phases different from the phase of the display pulse of the cell (2, 2). Therefore, the change of the lighting voltage does not arise among the adjacent cells, and a stable display is attained.

In the example illustrated in FIG. 6, the phases of the display pulses have been divided in the two sets for the odd-numbered display anode leads and the even-numbered display anode leads, but they may well be divided in three or more sets.

Although the embodiments have employed the voltage waveforms of FIG. 6 based on and changed from those of FIG. 3, they hold true for different driving waveforms.

Figure 11:
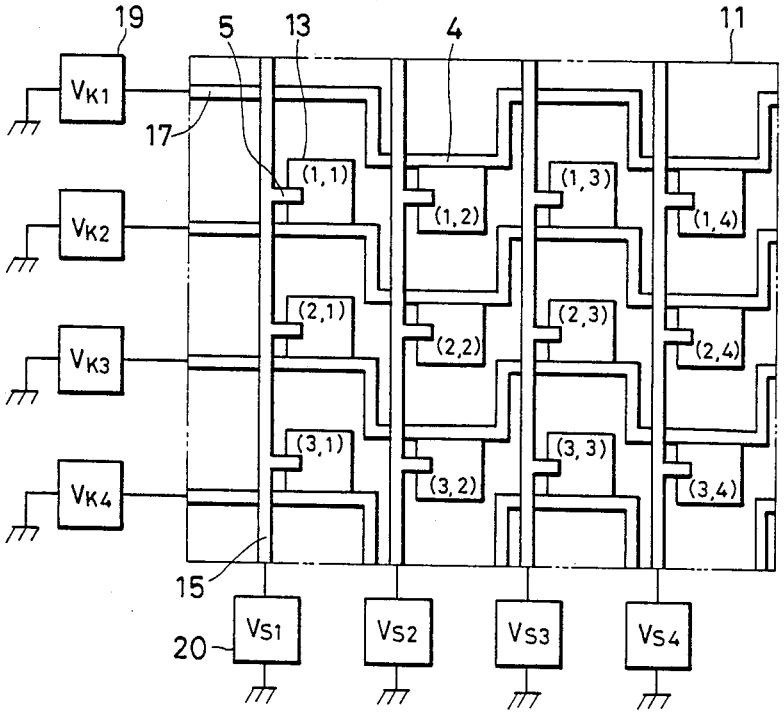
Figure 12:
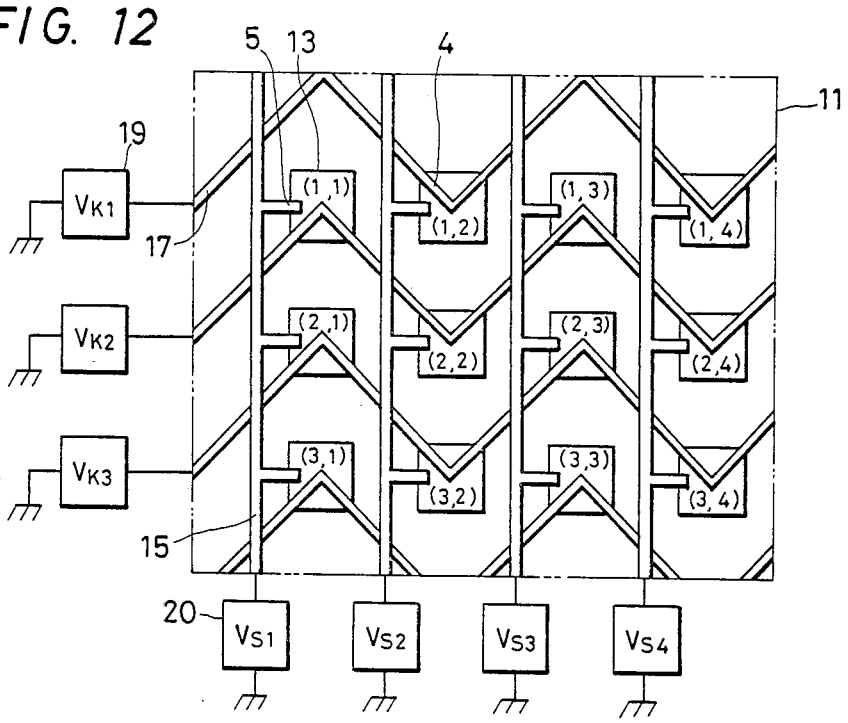

FIGS. 11 and 12 show other embodiments, in which the configurations of cathode wiring are modified. These embodiments produce the same effects as in FIG. 9.

Figure 13:
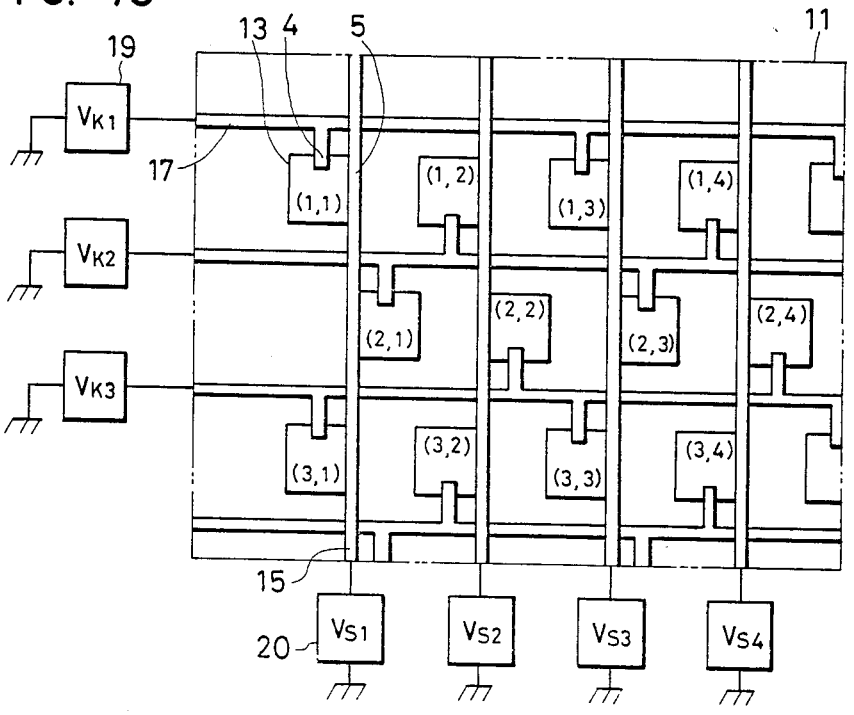
Figure 14:
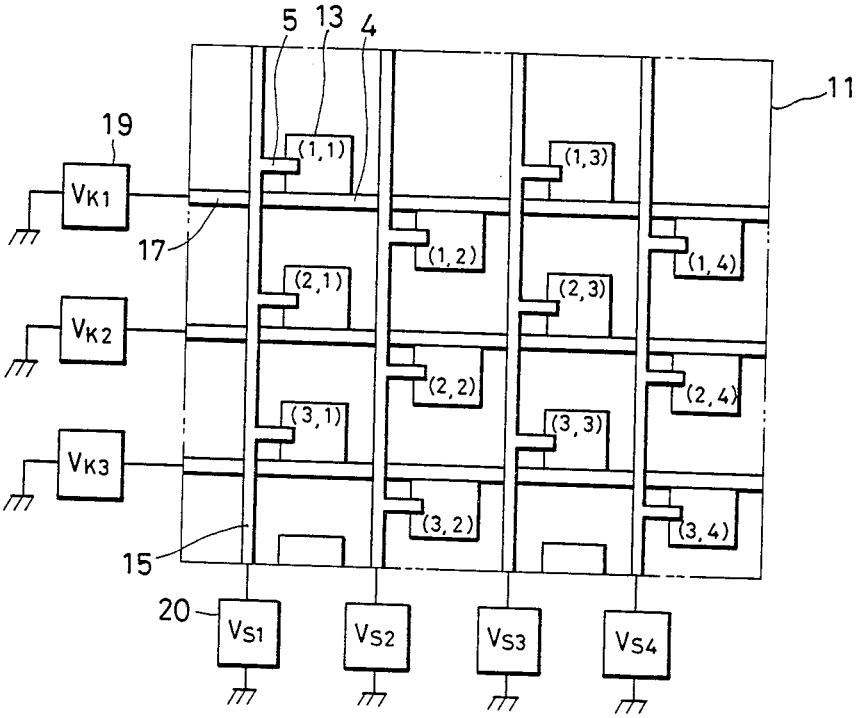

FIGS. 13 and 14 show panels in each of which the arrayal of discharge cells is shifted a half pitch every row. By wiring cathodes as exemplified in the drawing, the same effects as in FIG. 9 are attained.

As stated above, according to the present invention, it is possible to eliminate the crosstalk between adjacent discharge cells, to stabilize lighting operations and to prevent the flickering of a display screen.

We claim:

1. A gas-discharge display panel, comprising:

a gas-filled envelope which is formed of an insulating substrate and a light-transmissive faceplate;

a plurality of discharge cells which are arranged in the form of a matrix within said envelope and which have anodes and cathodes;

an anode lead between the (n)th and (n+1)th rows of cells (n being an integer) being connected to only every odd numbered cell in the (n)th row and to only every even numbered cell in the (n+1)th row; and a cathode lead between the (n)th and (n+1) the row of cells being connected to only every odd numbered cell in the (n)th row and to only every even numbered cell in the (n+1)th row.

2. A gas-discharge display panel, comprising:

a gas-filled envelope which is formed of an insulating substrate and a light-transmissive faceplate;

a plurality of discharge cells which are arranged in the form of a matrix within said envelope and which have anodes and cathodes;

an anode lead between the (n)th and (n+1)th rows of cells (n being an integer) being connected to only every even numbered cell in the (n)th row and to only every odd numbered cell in the (n+1)th row; and a cathode lead between the (n)th and (n+1)th rows of cells being connected to only every even numbered cell in the (n)th row and to only every odd numbered cell in the (n+1)th row.

* * * * *